US005711223A

United States Patent [19]

Taylor

[11] Patent Number: 5,711,223

[45] Date of Patent: Jan. 27, 1998

[54] MAGNETIC PLATE CYLINDER

[75] Inventor: Jefferson H. Taylor, Dallas, Tex.

[73] Assignee: Eugene L. Green, Sr., Dallas, Tex.

[21] Appl. No.: 514,894

[22] Filed: Aug. 14, 1995

[51] Int. Cl.[6] ..... B41F 27/02

[52] U.S. Cl. ..... 101/389.1; 335/295

[58] Field of Search ..... 101/389.1; 269/8; 335/295

[56] References Cited

U.S. PATENT DOCUMENTS

| | | | |
|---|---|---|---|
| 1,531,462 | 3/1925 | Marquardt | 101/382.1 |
| 2,952,205 | 9/1960 | Dunwoodie | 101/382.1 |
| 3,017,545 | 1/1962 | Meier | 101/382.1 |
| 3,079,535 | 2/1963 | Schultz | 335/295 |
| 3,206,655 | 9/1965 | Reijnst | 335/295 |
| 3,670,646 | 6/1972 | Welch, Jr. | 101/382 |
| 3,721,189 | 3/1973 | Bray | 101/382 |
| 3,734,017 | 5/1973 | Trier et al. | 101/378 |
| 3,742,852 | 7/1973 | Leffler et al. | 101/378 |
| 3,824,926 | 7/1974 | Fukuyama | 101/378 |
| 3,885,498 | 5/1975 | Jenkins | 101/382 |
| 3,919,937 | 11/1975 | Kostal | 101/378 |
| 4,029,013 | 6/1977 | George et al. | 101/382 |
| 4,072,920 | 2/1978 | Wright | 335/285 |
| 4,078,031 | 3/1978 | Bishop | 264/163 |
| 4,510,868 | 4/1985 | Fischer | 101/415.1 |
| 4,587,900 | 5/1986 | Oshio | 101/382 |
| 4,625,928 | 12/1986 | Peekna | 252/7.02 |
| 4,628,815 | 12/1986 | Van Kanegan | 101/415.1 |
| 4,676,161 | 6/1987 | Peekna | 101/378 |
| 4,823,697 | 4/1989 | Randazzo | 101/375 |
| 4,831,930 | 5/1989 | Leanna | 101/389.1 |
| 4,878,429 | 11/1989 | Russo | 101/486 |
| 4,890,553 | 1/1990 | Turner | 101/389.1 |
| 5,038,680 | 8/1991 | Bain | 101/401.1 |
| 5,255,604 | 10/1993 | Durr | 101/389.1 |

*Primary Examiner*—Stephen R. Funk
*Assistant Examiner*—Daniel J. Colilla
*Attorney, Agent, or Firm*—Dennis T. Griggs

[57] ABSTRACT

A magnetic plate cylinder for a printing press includes an outer cylinder member having circumferentially and axially spaced plugs of magnetic material or axially spaced apart rings of magnetic material for directing a magnetic field in such a way as to hold a magnetic printing plate on the outer surface of the outer cylinder member. An inner cylinder member includes circumferentially and axially spaced permanent magnet members supported on a cylinder of nonmagnetic material or stacked circular ring magnets interposed between rings of magnetic or nonmagnetic material for generating a magnetic field passing through the plugs or rings of magnetic material on the outer cylinder member. The inner cylinder member is disposed to form a radial air gap between the outer cylinder member and an outer surface of the inner cylinder member. The inner cylinder member can be rotated or axially translated relative to the outer cylinder member to change the intensity of the magnetic field to provide for positioning a printing plate on or removing a printing plate from the outer cylinder member. Ring magnets on the inner cylinder member may be of conventional polarization with poles on opposite side faces of the ring or with poles formed on the radially inner and outer circumferential surfaces of the ring.

17 Claims, 5 Drawing Sheets

2/5

MAGNETIC PLATE CYLINDER

FIELD OF THE INVENTION

The present invention relates to a magnetic printing plate cylinder having mechanism for changing the intensity of a magnetic field which holds the printing plate to the cylinder to improve the ease of mounting, demounting and adjusting the position of the printing plate with respect to the cylinder.

BACKGROUND

In the art of rotary printing press equipment, printing plates have been attached to plate cylinders by various means including mechanical fasteners and double-sided adhesive tape. Efforts to overcome the limitations of mechanical fasteners and adhesive tape devices have resulted in the development of magnetic plate cylinders wherein permanent magnets mounted on the cylinder provide a magnetic attraction force sufficient to hold a printing plate on a cylinder which is made of magnetic material or having a magnetic material backing.

A significant limitation on the use of conventional magnetic plate cylinders is that magnets of sufficient force to hold the printing plate on the cylinder also cause substantial difficulty in adjusting the position of the plate or removing the plate from the cylinder when it is desired to do so. Although the magnetic force supporting mechanism is attractive in many respects, the great difficulty created in attempting to remove magnetically attached printing plates from magnetic cylinders has often resulted in damage or destruction of the plates. Since, in many instances, printing plates are designed to be removed and then reinstalled later, any damage or destruction of the plates is unacceptable. Another limitation of conventional magnetic printing plate cylinders is that, with magnets which develop a sufficient holding force to retain the printing plates on the cylinder, the printing plates are often difficult to mount on the cylinder because the strength of the magnets causes an attraction force which tends to grab the printing plate away from the operator during the mounting and demounting operation or while attempting to adjust the position of the plate.

Accordingly, a magnetic printing plate cylinder is needed that is capable of providing an effective magnetic holding force for the printing plates but also provide for ease of mounting and removal of the printing plates whenever it is desired to do so.

DESCRIPTION OF THE PRIOR ART

Various efforts have been made to construct magnetic plate cylinders having selected arrangements of permanent magnets mounted on the cylinder body to provide a sufficient magnetic force field to retain the printing plate on the cylinder during printing press operations thereof. Printing plate cylinders have also been developed that include a movable magnet and locating pin assembly which advances a series of locating pins radially outwardly to permit initial registration and location of the printing plate on the cylinder and then retracts the pins while moving a permanent magnet in closer proximity to the printing plate to provide a plate holding force after the locating pins have been moved out of registration with the printing plate. Such a magnetic hold down assembly is, however, relatively complicated and expensive.

Magnetic printing plate cylinders have also been proposed wherein a series of permanent magnets are mounted along the central axis of the cylinder for generating a magnetic field between spaced apart plates of magnetic material spaced axially along the cylinder. An eccentric member of magnetic material is mounted adjacent to the magnets and is movable between positions which alter the intensity of the magnetic field to provide for supporting a magnetic printing plate on the cylinder and improving the ease with which the printing plate may be removed from the cylinder. The location of the magnets is, however, such that their strength is required to be particularly great to provide a sufficient magnetic holding force when required.

The present invention overcomes certain limitations of conventional magnetic plate cylinders by providing a unique arrangement of inner and outer cylinders which are rotatable with respect to each other to modify a radial air gap between the cylinders. The intensity of a magnetic field in the air gap varies as the magnetic poles are moved into and out of alignment with each other. This arrangement provides mounting and demounting magnetic printing plates with greater ease than heretofore realized and while also providing a cylinder construction which has certain advantages.

SUMMARY OF THE INVENTION

The present invention provides an improved magnetic printing plate cylinder for supporting printing plates thereon by magnetic forces which may be varied to improve the ease with which the printing plates are mounted on and demounted from the cylinder.

In accordance with one aspect of the present invention, a magnetic plate cylinder is provided wherein an inner cylinder member is radially spaced across a radial air gap from an outer cylinder member and is movable relative thereto. The inner cylinder member has one or more permanent magnets mounted thereon and operable to be moved in close proximity to elements of magnetic material mounted on the outer cylinder member. The inner cylinder member can be rotated relative to the outer cylinder member to move the permanent magnets toward and away from the elements of magnetic material to vary the intensity of the magnetic force holding the printing plate on the outer cylinder member. In this way, the magnetic force intensity acting on the printing plate may be turned "on" or "off" to provide for mounting and demounting the printing plate easily and without risk of plate damage.

In accordance with another aspect of the invention, a magnetic plate cylinder is provided wherein inner and outer cylinder members may be moved axially relative to each other or rotated relative to each other to change the intensity of a magnetic field being transmitted through the outer cylinder member to a printing plate supported thereon to increase or decrease the magnetic holding force on the printing plate.

In one embodiment of the invention, the inner cylinder has plural circumferentially and axially spaced permanent magnets supported on a cylinder member of nonmagnetic material, which magnets are disposed in close proximity to an inner wall of the outer cylinder member. The outer cylinder member has plural circumferentially and axially spaced apart elements of magnetic material which direct the magnetic flux of the magnets in such a way as to provide a substantial holding force for a magnetic printing plate supported on the outer cylinder member. The inner cylinder member may be rotated with respect to the outer cylinder member to move the magnets away from the elements of magnetic material to reduce the strength of the magnetic field.

In accordance with another embodiment of the present invention, a magnetic plate cylinder is provided having a plurality of axially spaced cylindrical ring magnets having axially spaced apart poles or radially spaced apart poles and which may be mounted on an inner cylinder member in such a way as to provide a magnetic field which passes through and is directed by elements of magnetic material, either rings or plugs, on the outer cylinder member to provide a sufficient magnetic holding force for a printing plate. The inner cylinder may also be rotated or moved axially relative to the outer cylinder to vary the intensity of the magnetic holding force.

The present invention provides various embodiments of a magnetic plate cylinder wherein the magnetic field appearing on the outer surface of the cylinder, which is effective for securing a magnetic printing plate to the cylinder, may undergo a change which is effected by changing the radial or axial distance between the magnets and the elements of magnetic material on the outer cylinder to effect changes in the intensity of the magnetic holding force. When the separation angle or axial distance is increased, the outer cylinder has a reduced magnetic attraction force for a printing plate of magnetic material or a plate supported on a backing of magnetic material.

Those skilled in the art will recognize the above-described features and advantages of the invention together with other superior aspects thereof upon reading the detailed description which follows in conjunction with the drawing.

DESCRIPTION OF THE PREFERRED EMBODIMENTS

Figure 1:
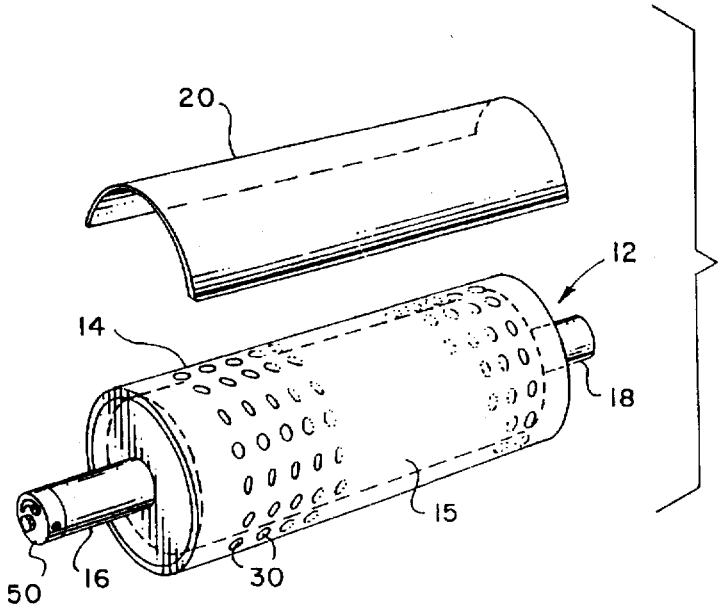
FIG. 1 is a perspective view of one preferred embodiment of a magnetic printing plate cylinder in accordance with the present invention.

In the description which follows, like parts are marked throughout the specification and drawing with the same reference numerals, respectively. The drawing figures are not necessarily to scale and certain features are shown in generalized or somewhat schematic form in the interest of clarity and conciseness.

Referring to FIG. 1, there is illustrated a unique magnetic printing plate cylinder in accordance with the invention and generally designated by the numeral 12. The plate cylinder 12 comprises an outer cylinder member 14 having opposed reduced diameter coaxial shafts 16 and 18 extending from opposite ends thereof and adapted to be supported on suitable bearings, not shown in FIG. 1. The cylinder 12 is of conventional construction with respect to the manner in which it is supported in the frame of a printing press and rotatably driven thereby. The cylinder 12 is also operable to support a somewhat flexible printing plate 20 which is adapted to be mounted on the cylinder 12 at least partially around the circumference of the outer cylinder member 14. The printing plate 20 is made of a suitable magnetic material or is supported on a backing of suitable magnetic material and is fabricated in a manner known to those of ordinary skill in the art. An improved arrangement of magnets and magnetic material elements are provided on the cylinder 12 for releasably securing the printing plate 20 on the outer surface 15 of the outer cylinder member 14 for operation of the cylinder 12 in conjunction with a rotary printing press also in a manner known to those of skill in the art.

Figure 2:
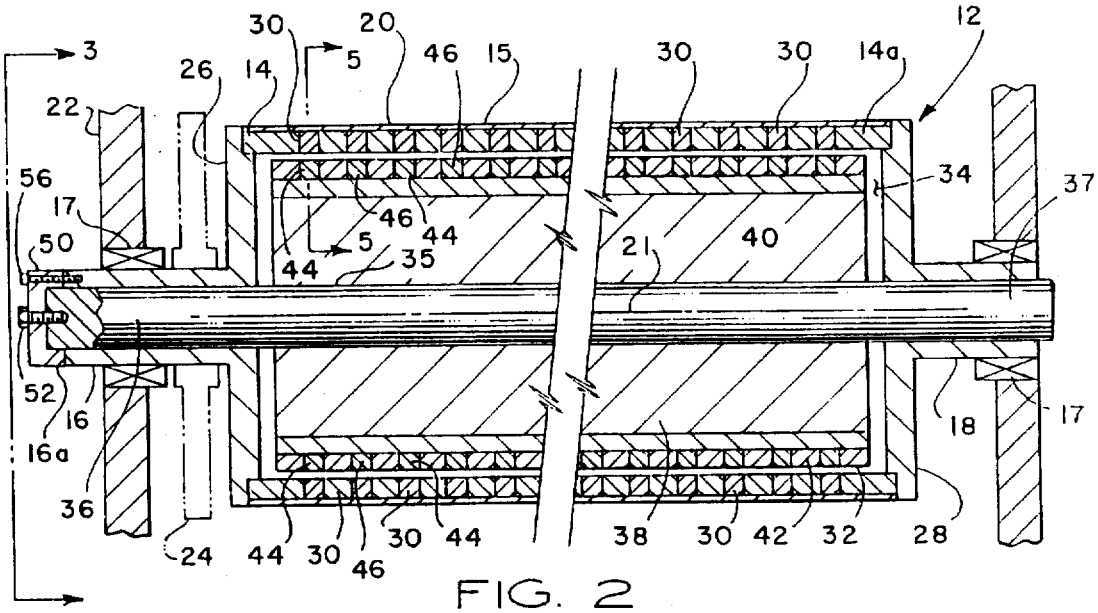
FIG. 2 is a longitudinal central section view of the plate cylinder of FIG. 1 mounted on a printing press frame.

Referring now to FIG. 2, the cylinder 12 is illustrated with its opposed shafts 16 and 18 supported for rotation in suitable bearings 17, respectively, which are mounted on a conventional press frame 22. Suitable drive gearing 24 is operable to be mounted on the shaft 16, for example, to rotatably drive the cylinder member 14 about the longitudinal central axis 21 of cylinder 12 and the coaxial shafts 16 and 18.

As shown in FIG. 2, the shafts 16 and 18 are formed as hollow cylindrical members which are suitably secured to or formed integral with opposed cylindrical end plates 26 and 28 of the outer cylinder member 14. The outer cylinder member 14 comprises a generally cylindrical tube 14*a*, preferably formed of a nonmagnetic material such as aluminum or a reinforced thermoplastic, for example, and may be secured to the end plates 26 and 28 by conventional fasteners, not shown.

Figure 4:
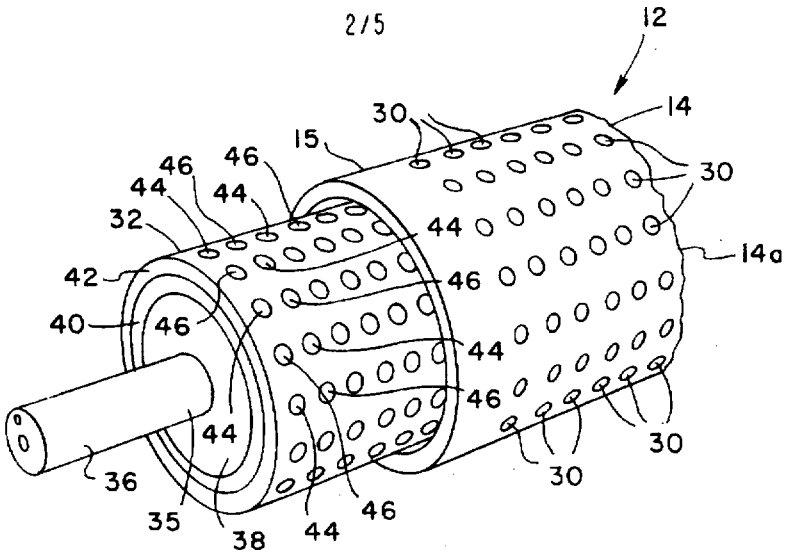
FIG. 4 is a perspective view of the inner and outer cylinders showing the spacing of the permanent magnets on the inner cylinder and the members of magnetic material on the outer cylinder.

Referring now to FIG. 4, the outer cylinder member 14 is shown with one of its end plates removed. The cylinder member 14 is provided with a plurality of circumferentially and axially spaced plug members 30 which are of generally cylindrical shape and are inserted in suitable bores 31 formed in the cylinder member and forcibly fitted therein or otherwise suitably secured in such bores by an adhesive, for example. The cylindrical plug members 30 are preferably formed of a material having ferromagnetic properties, such as various forms of iron, steel, cobalt, nickel and their alloys or other suitable materials exhibiting ferromagnetic characteristics.

Referring further to FIGS. 2 and 4, the plate cylinder 12 also includes an inner cylinder member, generally designated by the numeral 32, which is disposed in the hollow cylindrical interior space 34 formed by the cylinder member 14. The inner cylinder member 32 is provided with an elongated center shaft 35 having opposed cylindrical shaft portions 36 and 37 which extend through the hollow shaft members 16 and 18, as shown. The shaft 35 is adapted to support a cylindrical core member 38 of nonmagnetic material. The core member 38 supports a cylindrical ring member 40 on the outer circumference thereof and which is preferably made of a magnetic material and is coextensive with the core member.

The cylinder member 32 further includes an outer cylindrical sleeve member 42, also preferably made of a non-magnetic material, such as aluminum or thermoplastic, which is suitably secured to the ring member 40 to form an assembly which is supported on the shaft 35 and is non-rotatable relative to the shaft. The member 42 is adapted to support a plurality of axially and circumferentially spaced, generally cylindrical permanent magnets 44 and 46 disposed tightly in suitable bores formed in the member 42. The circumferential and axial spacing of the magnets 44 and 46 is such as to provide for alignment of these magnets with the plug members 30 disposed on the outer cylinder member 14.

Figure 5A:
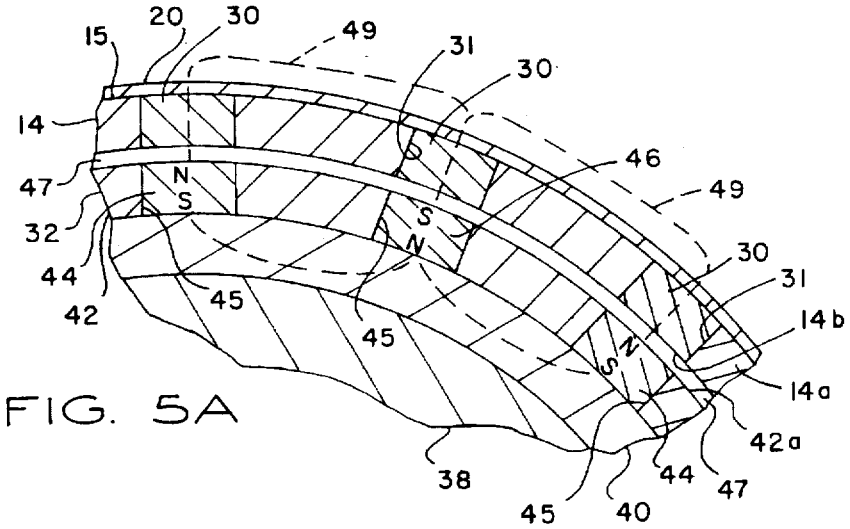
FIGS. 5A and 5B are detail transverse section views taken from line 5—5 of FIG. 2, showing the two positions of the inner cylinder relative to the outer cylinder for changing magnetic forces acting on a printing plate.

As shown in FIGS. 4 and 5A, the magnets 44 have magnetic poles N and S which are arranged so that the radially outer pole is N for the magnets 44 and the radially inner pole is N for the magnets 46, with respect to the diameter of the supporting ring member 42 and the axis 21. The magnets 44 and 46 may be identical and force fitted into suitable bores 45 formed in the ring member 42 or secured therein by an adhesive or the like. As indicated in FIG. 5A, the diameter of the outer circumferential surface **42*a* of the member 42 is slightly less than the diameter of the inner wall surface 14*b* of the cylinder member 14*a* so that a small radial clearance space 47 is provided between the inner cylinder 32** and the outer cylinder.

The arrangement of the magnets 44 and 46 is such that, when the magnets are radially aligned with the elements 30, as shown in FIG. 5A, a magnetic field is created having magnetic lines of force generally as indicated by the lines 49. By mounting the ring member 40 of magnetic material inside the ring member 42, the magnetic force lines 49 are shunted directly between adjacent magnets 44 and 46, as also indicated in FIG. 5A. The plug members 30 being formed of magnetic material direct the magnetic flux outwardly through the surface 15 of the outer cylinder member 14 a sufficient distance to impart a substantial magnetic force on the printing plate 20 securing the printing plate to the outer surface 15 of the outer cylinder 14.

Figure 5B:
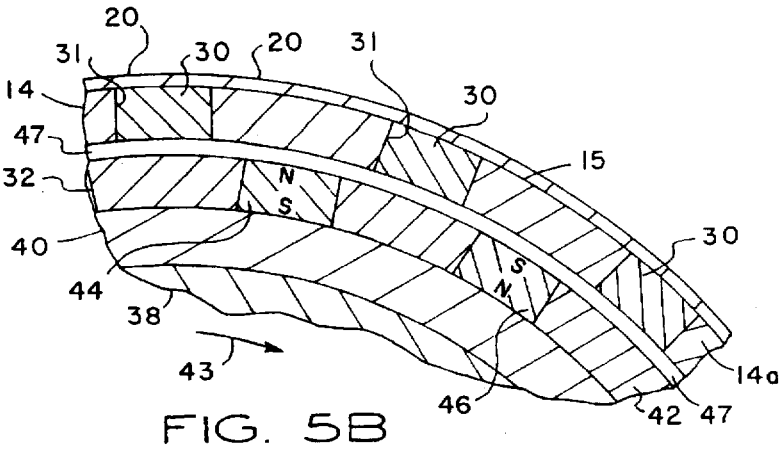

However, if the inner cylinder 32 is rotated about its central longitudinal axis, which is also the axis of rotation 21 of the entire plate cylinder 12, with respect to the cylinder member 14 to the position shown in FIG. 5B, the magnetic flux generated by the magnets 44 and 46, as seen by the printing plate 20, is substantially reduced since the magnets 44 and 46 are no longer aligned with the plugs 30. Relative rotation between cylinder members 14 and 32 is indicated by arrow 43 in FIG. 5B.

Accordingly, when the magnetic force holding the printing plate 20 is substantially reduced, the printing plate may be easily removed from or adjusted on the surface 15 of the outer cylinder 14. On the other hand, when the magnets 44 and 46 are aligned with the plug members 30 a sufficiently strong magnetic field exists to hold the printing plate 20 in place on the cylinder member 14. By merely rotating the inner cylinder member 32 a few degrees relative to the outer cylinder member 14, the forces exerted on the printing plate 20 can be substantially altered to effect retention or permit removal of the printing plate with respect to the cylinder 12.

Figure 3:
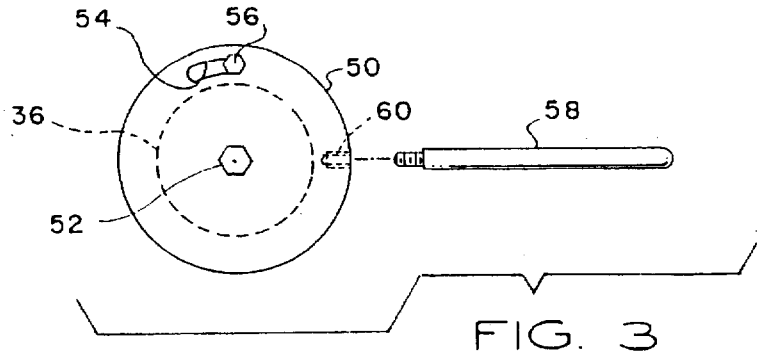
FIG. 3 is a transverse end view taken generally from the line 3—3 of FIG. 2.

The inner cylinder 32 may be secured non-rotatably with respect to the outer cylinder 14 by suitable means shown in FIGS. 2 and 3. For example, the shaft portion 36 of the inner cylinder 32 may be adapted to extend beyond the distal end **16*a* of the shaft 16 and have a suitable, generally cylindrical end cap 50 secured thereto by suitable fastener means 52, for example. As shown in FIG. 3, the end cap 50 may have an arcuate slot 54 formed therein for receiving a fastener 56 which may be threadedly engaged with the shaft end 16*a* to lock the shafts 34 and 16** non-rotatably with respect to each other.

When it is desired to rotate the inner cylinder 32 with respect to the outer cylinder 14 to turn the magnetic flux "on" or "off" with respect to the printing plate 20, the fastener 56 may be loosened and the inner cylinder member 32 rotated by inserting a cranking lever 58, FIG. 3, in a suitable threaded bore 60 formed in the end cap 50. The slot 54 is of sufficient length so as to permit rotation of the inner cylinder 32 only the amount indicated in FIG. 5B with respect to the outer cylinder 14. The outer cylinder 14 is normally held stationary by the gear train connected to the gear 24 and the shaft 16, for example. Other means may be utilized to hold the outer cylinder 14 against rotation with respect to the inner cylinder 32.

The rotary output shaft of an appropriate actuator or motor may be coupled to the shaft portion 37 of the inner cylinder 32 to set the angular position of the inner cylinder 32 in the magnetic flux "on" and "off" positions, respectively. The motor or actuator may be hydraulically or electrically operated and designed in accordance with certain stepping motor principles of operation. If such a motor or actuator is utilized, the end cap 50 and manually adjustable locking bolt 56 may be eliminated.

For a cylinder 12, having an outer diameter of the outer cylinder member 14 of about 7.00 inches and an inner diameter of the cylinder member 14 of about 6.25 inches, the gap 47 may be about 0.010 inches. Preferably, the inside and outside diameters of the cylinder member 14 are machined after securing the plugs 30 within bores 31 of the outer cylinder member. Interference fitting of these plugs may be a suitable technique for securing the plugs to the outer cylinder member. The diameter of the plugs 30 may be about 0.25 inches for the dimensions of the cylinder 12 described above. The surfaces of the plugs 30 will, of course, be flush with the inner and outer surfaces of the cylinder member 14. With the aforementioned gap dimension described, the diameter of the inner cylinder member 32 will be about 6.23 inches. The permanent magnets 44 and 46 may also have a diameter of 0.25 inches and a length of 0.25 inches.

The magnets 44 and 46 should also preferably be flush with the outer circumferential surface **42*a* of the supporting member 42. The magnets 44 and 46 should be positioned in the bores 45 after machining the outer surface 42*a* of the member 42 to prevent inadvertent degaussing. The circumferential and axial spacing of the magnets 44 and 46 may be varied as required to provide for the desired amount of holding force acting on the printing plate 20. The circumferential spacing of the magnets 44 and 46 may be on the order of about 1.38 inches, for example, and the axial spacing about 0.50 inches. The angular spacing of the magnets and the plugs 30** will vary with the diameter of the cylinder.

Figure 6:
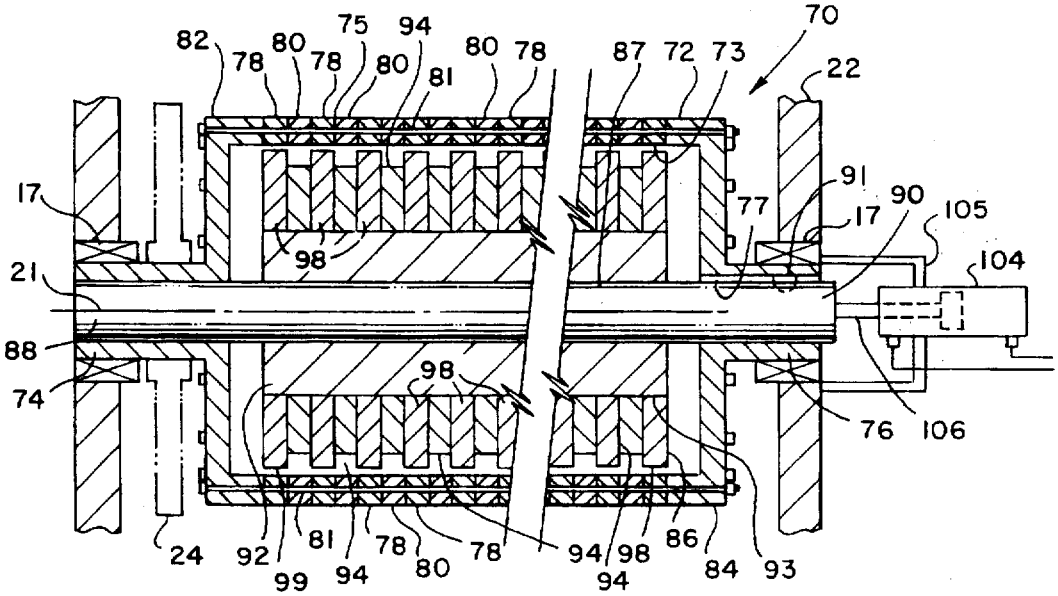
FIG. 6 is a longitudinal central section view of a first alternate embodiment of a magnetic printing plate cylinder in accordance with the invention.

Referring now to FIG. 6, there is illustrated another embodiment of a magnetic plate cylinder in accordance with the invention and generally designated by the numeral 70. The plate cylinder 70 includes an outer cylinder 72 comprising opposed generally cylindrical shaft portions 74 and 76 adapted to be supported in the bearings 17 of the press frame 22 in a manner generally similar to the arrangement shown in FIG. 2. The outer cylinder 72 is characterized by an axially extending stack of alternate, generally cylindrical rings 78 of magnetic material and rings 80 of nonmagnetic material.

The rings 78 and 80 are of the same diameter, preferably of about the same width and are suitably secured together by conventional means such as circumferentially spaced elongated bolts 81 which extend through suitable bores in the rings 78 and 80 between generally cylindrical end plates 82 and 84 secured to the support shafts 74 and 76, respectively. The rings 78 and 80 may also be secured together by a suitable adhesive or the like. Elongated tie rods formed by the bolt assemblies 81 are shown by way of example. Preferably, the bolt assemblies 81 and the end plates 82 and 84 are made of a nonmagnetic material. The rings 78 are formed of a suitable material having ferromagnetic properties and the rings 80 are preferably formed of a nonmagnetic material such as aluminum or a thermoplastic, for example.

The magnetic plate cylinder 70 includes an inner cylinder member 86 having a center shaft 87 including opposed generally cylindrical shaft portions 88 and 90 which are journalled in the cylindrical hollow shafts 74 and 76, respectively. The shaft portions 88 and 90 are adapted to be axially slidable in the support shafts 74 and 76 but non-rotatable relative thereto. One or the other of the shaft portions 88 and 90 may, for example, be suitably keyed to its supporting shaft 74 or 76 as indicated for the shaft portion 90 which includes key means 91 axially slidable in a slot 77 formed in shaft 76.

The shaft 87 is secured to a cylindrical core member 92 of nonmagnetic material which supports a plurality of spaced apart annular ring permanent magnets 94 which have approximately the same width as the ring members 80. Interposed between each of the magnets 94 and contiguous therewith, respectively, are generally cylindrical ring members 98 of magnetic material, such as mild steel, which each have an outer circumferential surface 99 of a diameter slightly less than the diameter of inner circumferential surface 73 of the outer cylinder member 72. For the dimensions of a plate cylinder, such as described heretofore for the embodiment shown in FIGS. 1 through 5B, the radial gap between the surfaces 99 and the surface 73 should also be on the order of about 0.010 inches. The magnets 94 and the rings 98 are suitably supported on the core member 92 and secured thereto by conventional means. For example, the magnets 94 and the rings 98 may be an interference fit on the outer circumference 93 of the nonmagnetic core member 92.

Figure 7A:
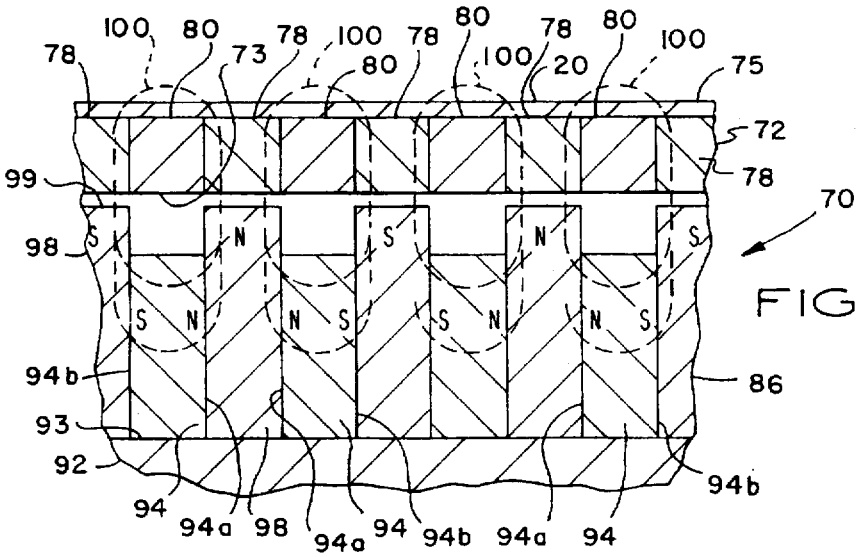
FIGS. 7A and 7B are detail axial section views showing two positions of the inner cylinder relative to the outer cylinder of the embodiment of FIG. 6.
Figure 7B:
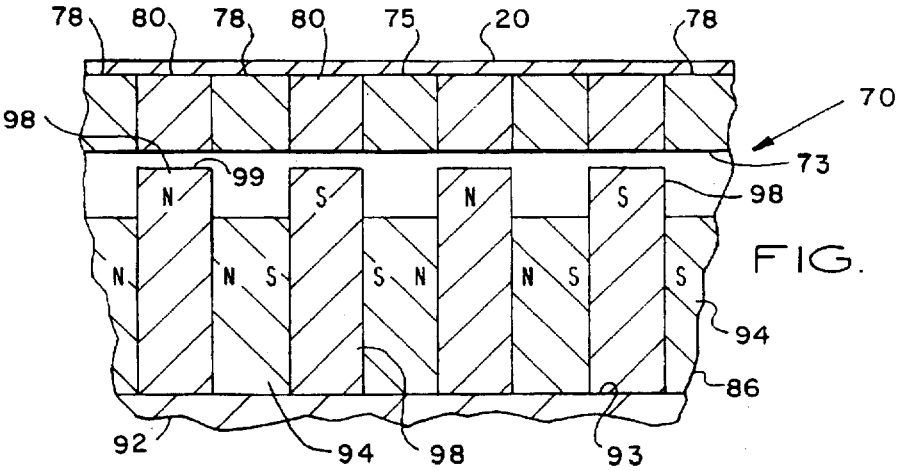

Referring now to FIGS. 7A and 7B, the magnets 94 have opposed, parallel planar faces **94*a* and 94*b* normal to axis 21. The magnets 94 are magnetized such that the faces 94*a* form one pole and the faces 94*b* form the other pole of the magnet. The magnets 94 may be similar to conventional ceramic ring magnets used in audio speakers and certain electric motors. When the magnets 94 are arranged disposed between the rings 98, as shown, the rings 98 act as magnetic pole pieces, as indicated, and magnetic flux fields are generated in the manner indicated by force lines 100. Accordingly, when the rings 98 are axially aligned with the rings 78, as shown in FIG. 7A, a magnetic flux field is generated which passes through a printing plate 20 and securely holds the printing plate to the outer surface 75 of the outer cylinder 72. However, when the inner cylinder 86 is shifted axially to the position shown in FIG. 7B, the magnetic flux field is substantially reduced since the ring members 98 are now axially aligned with the ring members 80 of nonmagnetic material. This reduction in the intensity of the magnetic fields generated by the respective magnets 94 and their cooperating ring members 98 is sufficient to permit easy removal of the printing plate 20 from cylinder 70** or mounting of the printing plate thereon.

FIG. 6 shows one example of a device for axially positioning the cylinder member 86 within the cylinder 72. Mechanism such as a hydraulic cylinder linear actuator 104 may be mounted on a frame member 105 suitably connected to the press frame 22, for example. The actuator 104 may be suitably connected to the shaft portion 90 by way of its piston rod 106, for example, for moving the inner cylinder 86 axially along the central longitudinal axis 21 between the positions shown in FIGS. 7A and 7B. In this way, the magnetic forces acting on the printing plate 20 may be turned "on" or "off". Thanks to the arrangement of the axially spaced poles of the magnets 94 and the interposed rings of magnetic material 98, the rings 98 act as magnetic poles themselves, as indicated in FIG. 7A, thus generating a magnetic field which flows through the rings 98 and intersects the printing plate 20 to attract and hold same to the surface 75. Those skilled in the art will recognize that the rings 78 may be replaced by circumferentially and axially spaced plugs of magnetic material similar to the plugs 30 and the entire outer cylinder member 72 may otherwise be formed of nonmagnetic material.

Figure 8:
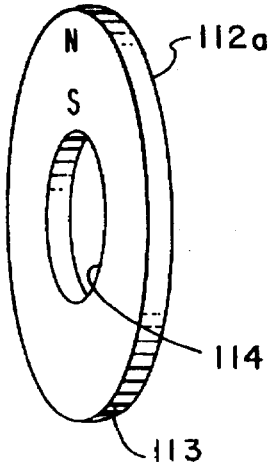
FIG. 8 is a perspective view of a ring magnet utilized in a preferred embodiment of the present invention shown in FIG. 9.
Figure 9:
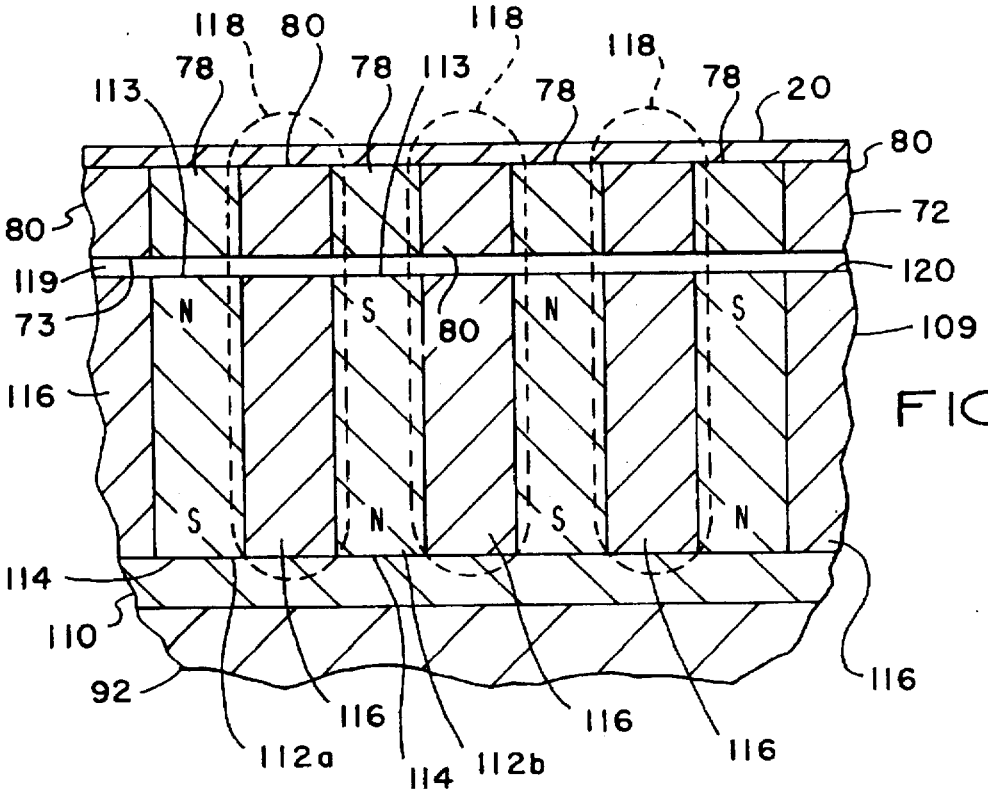
FIG. 9 is a detail axial section view showing the arrangement of the magnets on the inner cylinder of a second alternate embodiment in accordance with the present invention.

Referring now to FIGS. 8 and 9, the inner cylinder of the embodiment shown in FIGS. 6, 7A and 7B may be modified to form an inner cylinder 109, FIG. 9, which includes a cylindrical sleeve 110 of magnetic material suitably secured on the core member 92. In the embodiment of FIGS. 8 and 9, circular ring magnets **112*a* and 112*b* are provided and which replace the magnets 94. The magnets 112*a* and 112*b* each have an outer diameter 113 and an inner diameter 114 and these magnets are magnetized such that the poles are radially spaced apart as indicated in FIGS. 8 and 9. The magnets 112*a* and 112*b* have their poles reversed as indicated in FIG. 9. Thus, magnets 112*a* and 112*b* are preferably spaced apart as shown and have interposed therebetween circular rings 116** of the same diameters as the magnets and formed of nonmagnetic material.

In the position of the inner cylinder member 109 shown in FIG. 9, the magnetic rings **112*a* and 112*b* are axially aligned with the rings 78 of the outer cylinder member 72 to generate magnetic fields having magnetic lines of force 118, as indicated, which flow between the magnets 112*a* and 112*b* and through the rings 78 of magnetic material but are also shunted by the sleeve 110. A gap 119 is formed between the outer circumferential surface 120 of the inner cylinder member 109 and the inner surface 73 of the outer cylinder member 72. When the inner cylinder member 109 is shifted axially, in the same manner as described above for the inner cylinder member 86, to a position wherein the magnets 112*a* and 112*b* are axially aligned with the rings 80, the intensity of the magnetic fields generated by the magnets 112*a* and 112*b* acting on a printing plate 20** are substantially reduced.

Figure 10A:
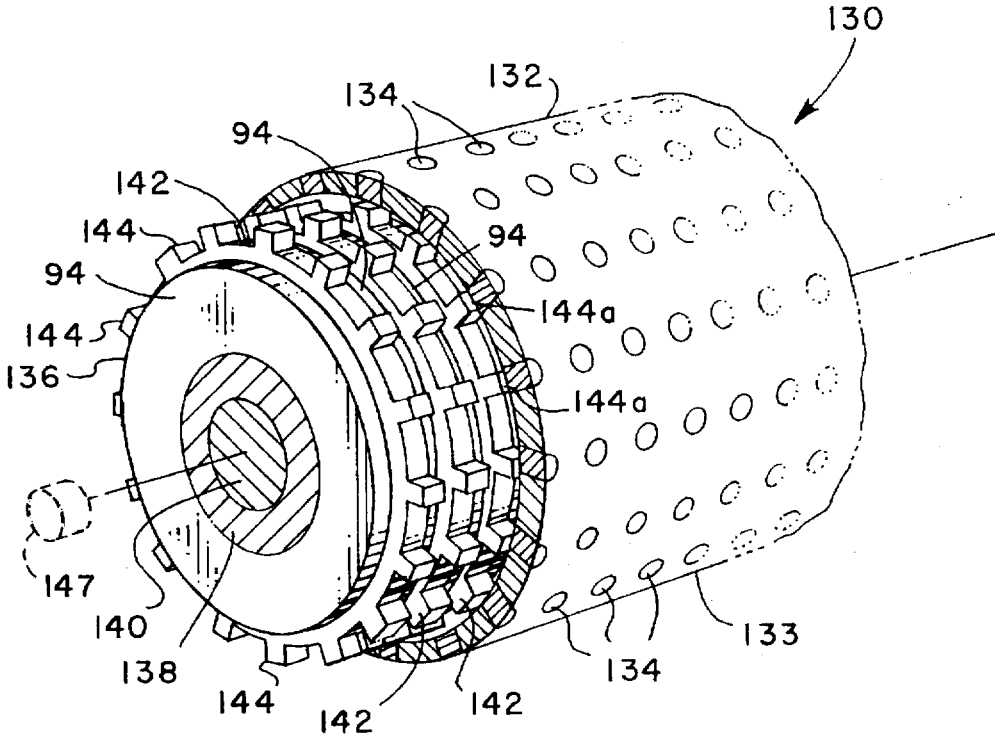
FIG. 10A is a perspective view of a third alternate embodiment of a magnetic printing plate cylinder in accordance with the invention.
Figure 10B:
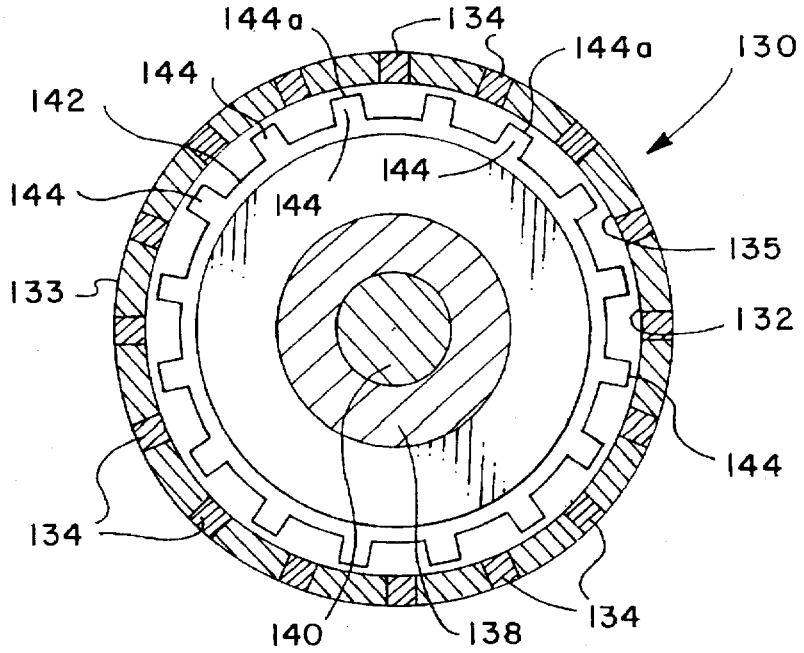
FIG. 10B is a transverse section view of the cylinder shown in FIG. 10A showing one of two working positions of the inner cylinder relative to the outer cylinder.

Referring now to FIGS. 10A and 10B, another embodiment of a magnetic plate cylinder in accordance with the invention is illustrated and generally designated by the numeral 130. The cylinder 130 is made up of an outer cylinder member 132 which is formed of a nonmagnetic material and has a plurality of circumferentially and axially spaced inserts or plug members 134 of magnetic material disposed therein in a manner similar to the outer cylinder member 14. The outer cylinder member 132 is, in fact, supported in the same manner as the cylinder member 14 and is otherwise substantially structurally identical to the cylinder member 14.

The plate cylinder 130 also includes an inner cylinder member 136 which is characterized by a generally cylindrical core member 138 of nonmagnetic material supported on a shaft 140. The core member 138 has a plurality of generally cylindrical rings 142 of magnetic material, disposed on and non-rotatably secured to the core member 138. Each of the rings 142 has plural circumferentially spaced and radially projecting teeth 144 which are dimensioned such that their radially distal ends 144*a* are disposed in close proximity to the plug members 134 when the cylinder members are in the relative positions shown in FIG. 10A. In other words, a small gap or space exists between the radially outermost surfaces 144*a* of the teeth 144 and the inner circumferential surface 135 of the cylinder 132.

Ceramic ring magnets 94 are supported on the core member 138 interposed between the rings 142 and in the same manner that the ring magnets 94 are supported on the core member 92 of the embodiment of FIGS. 6 and 7. Accordingly, the radially projecting teeth 144 of the members 142 are effective as pole pieces in the same manner as the rings 98, FIGS. 7A and 7B, to direct magnetic lines of force through the plug members 134 to effect a holding force on a printing plate 20 when the teeth 144 are aligned with the plug members 134 as shown in FIG. 10A.

However, the inner cylinder 136 may be connected to a suitable actuator 147, FIG. 10A, for rotating the inner cylinder to the position shown in FIG. 10B wherein the magnetic lines of force are now interrupted since the teeth 144 are no longer aligned with the plug members 134 thereby substantially reducing the magnetic holding force acting on a printing plate and enabling the plate to be positioned on the outer surface 133 of the cylinder 132 or removed therefrom.

The members 142 and 94 may be stacked on the core member 138 in the same manner that the members 94 and 98 are stacked on the core member 92 of the embodiment of FIGS. 6 and 7. However, the shaft 140 of the cylinder 130 is adapted to be supported on and rotated relative to the outer cylinder member 132 in the same manner as the arrangement of the cylinder 12 shown in FIGS. 1 through 5. Accordingly, the cylinder 130 enjoys all of advantages of the cylinder 12 and can utilize ceramic ring magnets with conventional polarization to provide effective holding forces on printing plates such as a printing plate 20.

The construction and operation of the various embodiments of a magnetic plate cylinder described hereinabove are believed to be readily understandable to those of ordinary skill in the art from the foregoing description. Although preferred embodiments of the invention have been described in detail herein, those skilled in the art will recognize that various substitutions and modifications may be made without departing from the scope and spirit of the appended claims.

What is claimed is:

1. A plate cylinder for supporting a printing plate by magnetic forces acting on said printing plate comprising:

an outer cylinder member having a generally cylindrical outer surface for engagement with said printing plate, at least portions of said outer cylinder member being formed of a magnetic material;

an inner member disposed within said outer cylinder member and movable relative to said outer cylinder member, said inner member including magnet means disposed thereon and operable to be positioned in proximity to said portions of said magnetic material on said outer cylinder member for directing magnetic lines of force in such a way as to retain said printing plate on said outer cylinder member;

positioning means coupled to said inner member for adjusting the axial position of said inner member relative to said outer cylinder member, thereby effecting a change in the magnetic forces holding said printing plate to provide for at least one of positioning said printing plate on said outer cylinder member and removing said printing plate from said outer cylinder member.

2. The plate cylinder set forth in claim 1 wherein:

said inner member comprises a generally cylindrical sleeve spaced radially inwardly from said outer cylinder member by a predetermined gap and said magnet means comprises a plurality of magnets supported on said sleeve and operable to be positioned adjacent to said portions of magnetic material on said outer cylinder member to create a magnetic field passing through said portions of magnetic material and said printing plate for holding said printing plate on said outer cylinder member.

3. The plate cylinder set forth in claim 2 wherein:

said magnet means comprise a plurality of circumferentially spaced magnets disposed about a central axis of said cylinder and supported on said inner member.

4. The plate cylinder set forth in claim 3 wherein:

said magnets include adjacent magnets having their respective poles aligned to maximize the magnetic field passing through said portions of magnetic material and said printing plate.

5. A plate cylinder for supporting a printing plate by magnetic forces acting on said printing plate comprising:

an outer cylinder member having a generally cylindrical outer surface for engagement with said printing plate, at least portions of said outer cylinder member being formed of a magnetic material;

an inner member disposed within said outer cylinder member and movable relative to said outer cylinder member, said inner member including magnet means disposed thereon and operable to be positioned in proximity to said portions of said magnetic material on said outer cylinder member for directing magnetic lines of force in such a way as to retain said printing plate on said outer cylinder member;

positioning means for moving said inner member relative to said outer cylinder member to effect a change in the magnetic forces holding said printing plate to provide for at least one of positioning said printing plate on said outer cylinder member and removing said printing plate from said outer cylinder member; and said magnet means comprise a plurality of circular ring magnets disposed on said inner member and arranged to generate a magnetic flux field passing through said portions of magnetic material on said outer cylinder member.

6. The plate cylinder set forth in claim 5 including:

members formed of magnetic material disposed on said inner member and between said ring magnets, respectively.

7. The plate cylinder set forth in claim 5 wherein:

said ring magnets have opposed faces, each of said faces comprising a magnetic pole of said ring magnet opposite the magnetic pole of the other face.

8. The plate cylinder set forth in claim 5 wherein:

said ring magnets have an outer diameter and an inner diameter and magnetic poles disposed adjacent said outer diameter and said inner diameter, respectively.

9. The plate cylinder set forth in claim 8 wherein:

said ring magnets are disposed spaced apart on said inner member and adjacent ones of said ring magnets have poles disposed adjacent said outer diameter of opposite polarity, respectively.

10. The plate cylinder set forth in claim 8 wherein:

said inner member comprises a cylindrical sleeve of magnetic material disposed adjacent the inner diameters of said ring magnets and forming a shunt for a magnetic field generated by said ring magnets.

11. The plate cylinder set forth in claim 5 wherein:

said inner member includes plural members of magnetic material interposed between said ring magnets.

12. The plate cylinder set forth in claim 11 wherein:

said members of magnetic material on said inner member comprise radially projecting teeth operable to be disposed adjacent said portions of magnetic material on said outer cylinder member for transmitting magnetic flux through said portions of said magnetic material.

13. The plate cylinder set forth in claim 12 wherein:

said inner member is rotatable relative to said outer cylinder member to change the intensity of a magnetic field passing through said portions of magnetic material on said outer cylinder member.

14. A plate cylinder for supporting a printing plate by magnetic forces acting on said printing plate comprising:

an outer cylinder member having a generally cylindrical outer surface for engagement with said printing plate, a plurality of elements disposed on said outer cylinder member, spaced apart, said elements being formed of a magnetic material;

an inner cylinder member disposed within said outer cylinder member and including plural spaced apart magnets disposed thereon and operable to generate magnetic lines of force which pass through said elements on said outer cylinder member to effect retention of a printing plate on said outer cylinder member;

a plurality of members of magnetic material disposed adjacent respective ones of said magnets and forming pole pieces for directing said magnetic lines of force toward said elements on said outer cylinder member to enhance the printing plate retention force provided by said magnets;

positioning means coupled to said inner cylinder member for moving said inner cylinder member relative to said outer cylinder member to effect a change in the intensity of magnetic forces acting on said printing plate;

said magnets comprise cylindrical ring magnets;

said ring magnets have poles disposed on opposed, parallel faces of said ring magnets, respectively; and, said pole pieces have circumferentially spaced apart radially projecting teeth operable to be disposed in close proximity to said elements on said outer cylinder member.

15. The plate cylinder set forth in claim 14 wherein:

said pole pieces comprise rings of magnetic material disposed adjacent to said opposed faces of said ring magnets, respectively.

16. The plate cylinder set forth in claim 14 wherein:

said ring magnets have poles disposed adjacent radially inner and outer circumferential surfaces of said ring magnets, respectively.

17. The plate cylinder set forth in claim 14 including:

rings of nonmagnetic material disposed on said inner cylinder member between said ring magnets, respectively.

* * * * *